US006308989B1

(12) United States Patent
La Porta

(10) Patent No.: US 6,308,989 B1
(45) Date of Patent: Oct. 30, 2001

(54) BASEBALL SCORE CARD AND METHOD

(76) Inventor: Thomas C. La Porta, 5303 Shadyside Dr., Clarence, NY (US) 14031

( * ) Notice: Subject to any disclaimer, the term of this patent is extended or adjusted under 35 U.S.C. 154(b) by 0 days.

(21) Appl. No.: 09/373,196

(22) Filed: Aug. 12, 1999

(51) Int. Cl.[7] ..... G09B 19/00
(52) U.S. Cl. ..... 283/49; 283/48.1
(58) Field of Search ..... 281/38, 21.1, 45, 281/51; 283/48.1; 40/70; 273/239, 240, 288; 116/222, 223–25, 209

(56) References Cited

U.S. PATENT DOCUMENTS

D. 292,969 * 12/1987 Love ..... D21/28
D. 332,806 * 1/1993 Blimline ..... D21/28
1,042,142 * 10/1912 Pohlig .
2,355,905 * 8/1944 Buxbaum .
2,359,253 * 9/1944 Silano ..... 116/222
3,554,159 * 1/1971 Klupt ..... 116/120
4,141,560 * 2/1979 Kaslow ..... 273/244
4,212,261 * 7/1980 Gaetano ..... 116/224
5,390,933 * 2/1995 Krans ..... 273/244
5,556,135 * 9/1996 Duncan ..... 283/48.1
5,782,470 * 7/1998 Langan ..... 273/39
5,788,283 * 8/1998 Adler ..... 281/38
5,820,127 * 10/1998 Rodriguez ..... 273/280
6,102,797 * 8/2000 Kail ..... 273/139

* cited by examiner

*Primary Examiner*—Willmon Fridie, Jr.

(57) ABSTRACT

A baseball score card and method for providing a reusable device for keeping records of the events occurring during a baseball game. The baseball score card and method includes a planar sheet member having a front face and a rear face. Each face includes sections having indicia arranged for facilitating keeping records of the events occurring during a baseball game. The faces are selectively markable to correspond to play results. In an embodiment, the planar sheet member is laminated to permit wiping away of markings in the sections on each face.

1 Claim, 3 Drawing Sheets

BASEBALL SCORE CARD AND METHOD

BACKGROUND OF THE INVENTION

1. Field of the Invention

The present invention relates to baseball statistic recording cards and more particularly pertains to a new baseball score card and method for providing a reusable device for keeping records of the events occurring during a baseball game.

2. Description of the Prior Art

The use of baseball statistic recording cards is known in the prior art. More specifically, baseball statistic recording cards heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 402,700; U.S. Pat. No. 5,664,780; U.S. Pat. No. 2,145,664; U.S. Pat. No. 1,601,119; U.S. Pat. No. Des. 352,956; and U.S. Pat. No. 5,556,135.

While these devices fulfill their respective, particular objectives and requirements, the aforementioned patents do not disclose a new baseball score card and method. The inventive device includes a planar sheet member having a front face and a rear face. Each face includes sections having indicia arranged for facilitating keeping records of the events occurring during a baseball game. The faces are selectively markable to correspond to play results. In an embodiment, the planar sheet member is laminated to permit wiping away of markings in the sections on each face.

In these respects, the baseball score card and method according to the present invention substantially departs from the conventional concepts and designs of the prior art, and in so doing provides an apparatus primarily developed for the purpose of providing a reusable device for keeping records of the events occurring during a baseball game.

SUMMARY OF THE INVENTION

In view of the foregoing disadvantages inherent in the known types of baseball statistic recording cards now present in the prior art, the present invention provides a new baseball score card and method construction wherein the same can be utilized for providing a reusable device for keeping records of the events occurring during a baseball game.

The general purpose of the present invention, which will be described subsequently in greater detail, is to provide a new baseball score card and method apparatus and method which has many of the advantages of the baseball statistic recording cards mentioned heretofore and many novel features that result in a new baseball score card and method which is not anticipated, rendered obvious, suggested, or even implied by any of the prior art baseball statistic recording cards, either alone or in any combination thereof.

To attain this, the present invention generally comprises a planar sheet member having a front face and a rear face. Each face includes sections having indicia arranged for facilitating keeping records of the events occurring during a baseball game. The faces are selectively markable to correspond to play results. In an embodiment, the planar sheet member is laminated to permit wiping away of markings in the sections on each face.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new baseball score card and method apparatus and method which has many of the advantages of the baseball statistic recording cards mentioned heretofore and many novel features that result in a new baseball score card and method which is not anticipated, rendered obvious, suggested, or even implied by any of the prior art baseball statistic recording cards, either alone or in any combination thereof.

It is another object of the present invention to provide a new baseball score card and method that may be easily and efficiently manufactured and marketed.

It is a further object of the present invention to provide a new baseball score card and method that is of a durable and reliable construction.

An even further object of the present invention is to provide a new baseball score card and method which is susceptible of a low cost of manufacture with regard to both materials and labor, and which accordingly is then susceptible of low prices of sale to the consuming public, thereby making such baseball score card and method economically available to the buying public.

Still yet another object of the present invention is to provide a new baseball score card and method which provides in the apparatuses and methods of the prior art some of the advantages thereof, while simultaneously overcoming some of the disadvantages normally associated therewith.

Still another object of the present invention is to provide a new baseball score card and method for providing a reusable device for keeping records of the events occurring during a baseball game.

Yet another object of the present invention is to provide a new baseball score card and method which includes a planar sheet member having a front face and a rear face. Each face includes sections having indicia arranged for facilitating keeping records of the events occurring during a baseball game. The faces are selectively markable to correspond to play results. In an embodiment, the planar sheet member is laminated to permit wiping away of markings in the sections on each face.

Still yet another object of the present invention is to provide a new baseball score card and method that provides a number of preprinted indicia positioned within sections of a sheet, the indicia corresponding to possible play results.

Even still another object of the present invention is to provide a new baseball score card and method that permits temporary marking of a sheet to correspond to highly individualized results while simultaneously providing an organized neat set of indicia for marking corresponding to more common play results in the sport of baseball.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
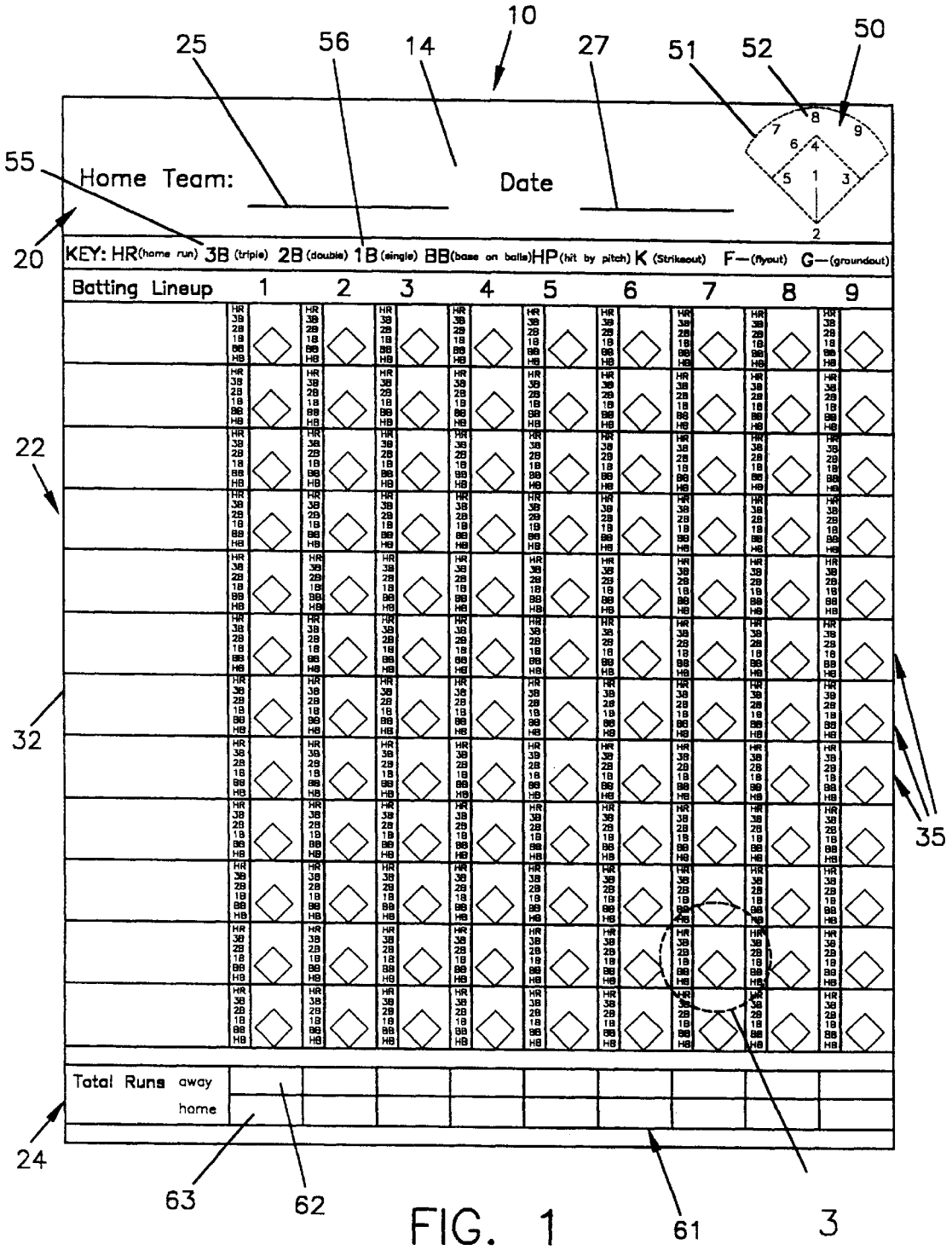
FIG. 1 is a front view of a new baseball score card and method according to the present invention.
Figure 2:
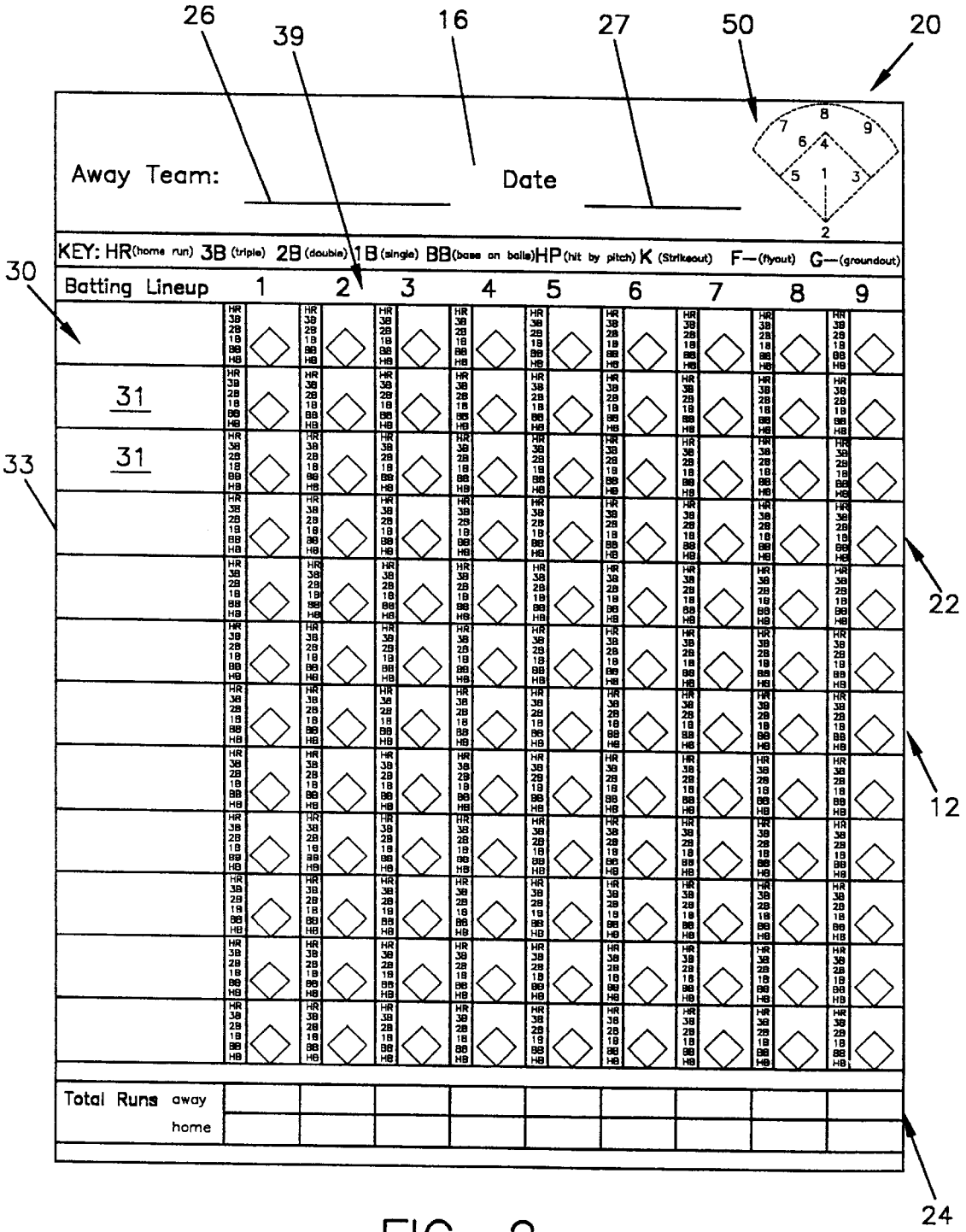
FIG. 2 is a rear view of the present invention.
Figure 3:
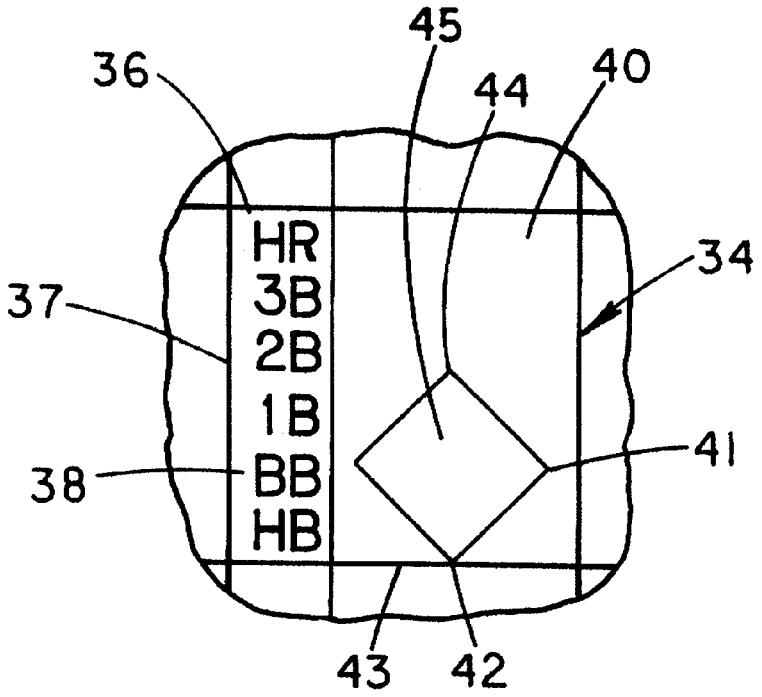
FIG. 3 is an enlarged view of the area designated as 3 in FIG. 1.
Figure 4:
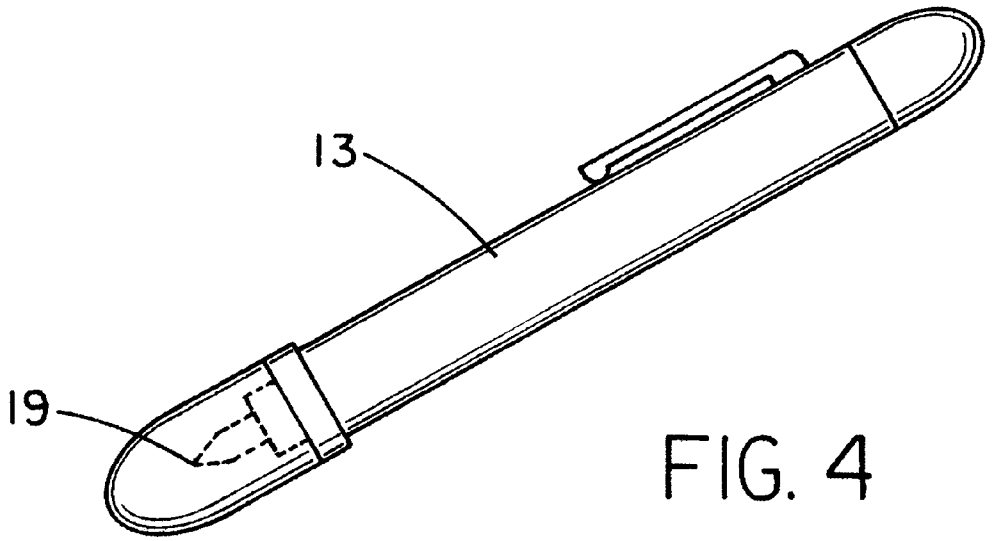
FIG. 4 is a side view of a marker of the present invention.

With reference now to the drawings, and in particular to FIGS. 1 through 4 thereof, a new baseball score card and method embodying the principles and concepts of the present invention and generally designated by the reference numeral 10 will be described.

As best illustrated in FIGS. 1 through 4, the baseball score card and method 10 generally comprises a sheet member 12 having a front face 14 and a rear face 16, and a marker 13 having a fine point 19 for marking on the sheet member. The front face and the rear face each includes a top section 20, medial section 22 and a lower section 24.

In an embodiment of the invention, the sheet member has a smooth surface for facilitating marking on the sheet member with either an erasable or dry erase type marker. Also in an embodiment of the invention, the sheet member is constructed of plastic or is laminated.

The top section of the front face and the rear face each include a respective one of a home team line indicia 25 and an away team line indicia 26, each line indicia being designed for facilitating legible marking of a home or away team name above the respective team line indicia.

The top section of the front face and the rear face each include a respective date line indicia 27 designed for facilitating marking of a date of game played above the respective date line indicia.

The medial portion of the front face and the rear face each includes a single lineup column 30 of lineup spaces 31 aligned proximate respective sides 32 and 33 of the sheet member. Each of the lineup spaces is designed for marking a player indicator such as a name or number within the lineup space.

The medial portion of the front face and the rear face each further includes a plurality of result columns 39 positioned adjacent to the lineup column. Each activity column includes a plurality of activity spaces 34. The result columns are positioned to form a plurality of activity space rows 35 aligned with a respective one of the lineup spaces.

Each activity space includes a first region 36 adjacent to a first side 37 of the activity space. Each first region also includes a list of result indicia 38 positioned within the first region.

Each activity space further has a second region 40 having a diamond indicia 41 positioned within the second region. Each diamond indicia includes a lowermost point 42 positioned along a lower edge 43 of the activity space. Each diamond indicia also includes an uppermost point 44 positioned within an interior portion 45 of the second region of the activity space.

In an embodiment, the plurality of activity columns comprises nine columns, each column corresponding to one inning of a nine inning baseball game. Greater or fewer numbers of columns may be provided to correspond to the appropriate number of innings for a level of play or to provide additional columns for extra innings.

The top sections of the front face and the rear face each includes a positional indicator 50. Each positional indicator has position indicia 51 in the general shape of a playing surface of a baseball diamond including a generally arcuate outfield representational portion 52. The position indicia are numbered such that each number corresponds to a baseball player position. Typically, 1 indicates the pitcher, 2 indicates the catcher, 3 indicates the first baseman, 4 indicates the second baseman, 5 indicates the third baseman, 6 indicates the shortstop, 7 indicates the left fielder, 8 indicates the center fielder, and 9 indicates the right fielder.

In an embodiment, the front face and the rear face also each including a key portion 55 positioned between the top section and the medial section. The key portion has a plurality of alphanumeric indicators 56, each alphanumeric indicator being associated with a corresponding play result. Typically, 1B indicates a single, HR indicates a home run, 2B indicates a double, 3B indicates a triple, BB indicates a walk or base on balls, HP indicates a hit batsmen, K indicates a strike out, F indicates a fly ball, G indicates either a ground ball or a ground out, and E indicates an error.

The lower section of the front and rear faces each includes a plurality of run columns 61. Each run column is divided into an upper and a lower division 62 and 63. Each division is for recording a number of runs scored by a respective team associated with each respective division 62 or 63.

In use, the marker 13 is used to record a lineup of players into the lineup column by recording one respective player name in each lineup space. Each player's results are then recorded in an activity space aligned with the player's lineup space and a column of activity spaces corresponding to the inning in the baseball game in which the result occurred. For clarity the results are recorded using one of the result indicia within the first region or marking a corresponding alphanumeric indicator from the key portion within the second region.

Runs per inning are recorded in the run column corresponding to the inning of the baseball game in which the runs were scored.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A base ball score keeping card system, the system comprising:

a sheet member having a front face and a rear face, said front face and said rear face each having a top section, medial section and a lower section;

a maker for marking on the sheet member;

said top section of said front face and said rear face each having a respective home team line indicia adapted for facilitating marking of a home team name above said home line indicia;

said top section of said front face and said rear face each having a respective date line indicia adapted for facilitating marking of a date of game played above said date line indicia;

said medial section of said front face and said rear face each having a single lineup column of lineup spaces aligned proximate respective sides of said sheet member, each of said lineup spaces being adapted for marking a player indicator within said lineup space;

said medial section of said front face and said rear face each further having a plurality of result columns positioned adjacent to said lineup column, each result column including a plurality of activity spaces;

each activity space having a first region adjacent a first side of said activity space, each first region having a list of result indicia positioned within said first region;

each activity space further having a second region having a diamond indicia positioned within said second region, each diamond indicia having a lowermost point positioned along a lower edge of said activity space, each diamond indicia having an uppermost point positioned within an interior portion of said second region of said activity space;

wherein said plurality of result columns comprises nine columns;

said top section of said front face and said rear face each including a positional indicator, said positional indicator having position indicia in the general shape of a playing surface of a baseball diamond including a generally arcuate outfield representational portion, said position indicia being numbered such that each number corresponds to a baseball player position;

said front face and said rear face each including a key portion positioned between said top section and said medial section, said key portion having a plurality of alphanumeric indicators, each alphanumeric indicator being associated with a corresponding play result;

said lower section of said front face and said rear face each having a plurality of columns, each column being divided into an upper and a lower division, each division being for recording a number of runs scored by a respective team associated with each respective division.

* * * * *